US007201812B2

(12) United States Patent
Ogawa

(10) Patent No.: US 7,201,812 B2
(45) Date of Patent: Apr. 10, 2007

(54) METHOD FOR MANUFACTURING SEAMLESS STEEL TUBE

(75) Inventor: Hidenori Ogawa, Osaka (JP)

(73) Assignee: Sumitomo Metal industries, Ltd., Osaka (JP)

( * ) Notice: Subject to any disclaimer, the term of this patent is extended or adjusted under 35 U.S.C. 154(b) by 422 days.

(21) Appl. No.: 10/414,034

(22) Filed: Apr. 16, 2003

(65) Prior Publication Data

US 2003/0196734 A1 Oct. 23, 2003

(30) Foreign Application Priority Data

Apr. 18, 2002 (JP) ..... 2002-115708

(51) Int. Cl.
*C21D 8/10* (2006.01)

(52) U.S. Cl. ..... 148/592; 148/593; 148/651

(58) Field of Classification Search ..... 148/909, 148/592, 593, 621, 651, 510
See application file for complete search history.

(56) References Cited

U.S. PATENT DOCUMENTS

| | | | | |
|---|---|---|---|---|
| 3,118,328 A | | 1/1964 | Issott | |
| 3,422,518 A | | 1/1969 | French | |
| 4,102,711 A | * | 7/1978 | Kunitake et al. | 148/593 |
| 4,354,882 A | * | 10/1982 | Greer | 148/541 |
| 4,394,189 A | * | 7/1983 | Greer | 148/541 |
| 5,016,460 A | | 5/1991 | England et al. | |
| 6,485,679 B1 | * | 11/2002 | Sundstrom et al. | 420/38 |

FOREIGN PATENT DOCUMENTS

| | | |
|---|---|---|
| DE | 284 420 A | 11/1990 |
| JP | 58-164723 A | 9/1983 |
| JP | 58173022 | 10/1983 |
| JP | 60166108 | 8/1985 |
| JP | 02217105 | 8/1991 |
| JP | 03281006 | 12/1991 |

* cited by examiner

*Primary Examiner*—Deborah Yee
(74) *Attorney, Agent, or Firm*—Clark & Brody

(57) ABSTRACT

A method for manufacturing a seamless steel tube, wherein a tubing material for the seamless steel tube is produced by a hot working process from a material having less workability, such as a high Cr—high Ni—high C alloy steel including Cr at a content not less than 15 weight % and Ni at a content not less than 20 weight % or a ferritic stainless steel including Cr at a content not less than 16 weight %, and then cold drawn at a reduction rate of not less than 15% and further cold rolled after applying an appropriate heat treatment, so that a round or an inner grooved steel tube is obtained. It is preferable that the hot extrusion process is employed for the hot working process and a cold Pilger mill is employed for the cold rolling process. In the cold rolling process, the crackings or damage resulting from the reduced toughness of the tubing material as well as the breakage of a mandrel in producing the round or the inner grooved tube can be suppressed.

3 Claims, No Drawings

METHOD FOR MANUFACTURING SEAMLESS STEEL TUBE

FIELD OF THE INVENTION

The present invention relates to a method for manufacturing a seamless steel tube from a material having less workability, and more specifically to a method for manufacturing a seamless steel tube, wherein a round tube or an inner grooved tube is manufactured by the cold working process from a tubing material which is manufactured from a high Cr—high Ni—high C alloy steel or a ferritic stainless steel by the hot working process.

DESCRIPTION OF THE PRIOR ART

In the manufacture of a seamless steel tube having less workability, there is a limitation regarding the conditions of producing such a steel tube, since a material for the steel tube normally has a high deformation resistance in the state of a hot-worked steel tube. Due to the limitation regarding the conditions of manufacturing a tube, there is a possibility that a steel tube having a required size precision cannot be obtained, and further the generation of defects resulting from the properties of the material itself makes it difficult to manufacture a tube having a desired quality. As a result, in particular in the manufacture of a seamless steel tube from a material having less workability, the cold working process is applied to a tubing material, which is manufactured by the method for manufacturing a steel tube in the hot working process.

In the method for manufacturing such a tubing material for the seamless steel tube in the hot working process, either a hot-piercing method based on the Mannesmann tube-making process or a hot extrusion process based on the Ugine—Sejournet tube-making process is traditionally employed. In these methods, a solid or pierced round billet heated at high temperature is used as a work piece to be processed and is fed to a roll mill or an extrusion machine to form a tubing material having a hollow cylindrical shape.

In the cold working of the tubing material thus formed, either the cold drawing process by means of a draw bench or a cold rolling process by means of a cold Pilger mill is conventionally employed. In these processes, scale formed on the tubing material during the hot working process is removed, and then the outer surface of the tube, onto which the lubricant process is applied, is processed with a dice, together with the machining of the inner surface with both a plug and a mandrel, thereby allowing a steel tube to be manufactured within a predetermined size. The steel tube thus manufactured has much more excellent properties regarding the quality and the tolerance of size, compared with the steel tube manufactured by the hot working process.

In particular, the cold rolling process by the cold Pilger mill provides a greater rate of reduction in the cold working for the tubing material, compared with the cold drawing process. As a result, the cold rolling process is normally employed to manufacture a seamless steel tube from such a tubing material having less workability. When, however, a hot worked tubing material having less workability is cold rolled after the surface treatment and the lubricating treatment, crackings in the material and breakage or damages in the tools often generate.

This general trend results from an insufficiency in the uniform distribution of solidified carbides, since there is a local variation in the temperature distribution inside a billet as well as there is variation in both the cooling start temperature and cooling rate after the hot working of the steel tube, and further it results from a marked reduction in the toughness after hot working of the steel tube, since the intermetallic compounds are precipitated therein, although these effects partially depend on the composition of the material having less workability.

Moreover, it is found that every hot-worked tubing material varies in the size. The hot extrusion process is mostly employed for manufacturing such a tubing material having less workability, since this process can process the billet with a relatively higher rate of reduction and is more efficient in the productivity. From the viewpoint, a variation in the size of the tubing material, which is manufactured by the hot extrusion process, will be exemplified. In the case of the hot-extruded tubing material, a variation in the heat temperature of a billet and/or a size variation in an extruding tool, i.e., a dice or a mandrel, causes the size in the longitudinal direction of every tube to be varied even within the same lot of production.

When a tubing material having a different size in every tube is cold-rolled with a mandrel or a roll having a fixed size, the rate of reduction is changed due to the size variation of the tubing material. As a result, the load applied to the mandrel is largely altered even for the same type tubing material, and an excessive load causes the mandrel to be broken. In order to prevent the mandrel from breaking off, the rate of reduction in the cold rolling has to be set smaller with estimating the size variation of the tubing material.

When manufacturing a seamless steel tube having a shape other than the round shape, the cold working process can also be applied to a tubing material, which is manufactured by a hot working process. For instance, in order to enhance the rate of heat exchanging, a cracking tube in ethylene plant is used an inner grooved tube such that it is formed a plurality of straight or inclined grooves in the axial direction and is made the inside peripheral length longer. An inner grooved tube is normally required a longer one in such a plant and is manufactured by the centrifugal casting process or the hot extrusion process since the length of processing is limited in the machining process such as cutting or the like.

However, an inner grooved tube having a small diameter cannot be manufactured by the centrifugal casting process. The other hand, by the hot extrusion process, an inner grooved tube having straight grooves or having inclined grooves by twist processing the inner grooved tube can be manufactured. Such a steel tube, however, has insufficient accuracy of machining in the size and an inner grooved tube having a small diameter and thickness cannot be manufactured since the extrusion press ability is limited when a material having a high deformation resistance, such as high Cr—high Ni—high C alloy steel, is used.

Accordingly, an inner grooved tube in a high dimensional precision from a material having a high deformation resistance and less workability, especially having a small diameter and thickness, has to be manufactured by the cold rolling process, which is manufactured by the hot extrusion process or the like. However, an increase in the rate of reduction for an inner grooved tube having a small diameter and thickness, using such a material having less workability, causes an excessive load to be applied to the mandrel, and therefore a possible breakage occurs in the mandrel.

In order to prevent a mandrel from breaking in the cold rolling process, U.S. Pat. No. 5,016,460 discloses a method for manufacturing an inner grooved tube under reducing the load applied to the mandrel and enabling the service life of the mandrel to be increased. In the disclosed manufacturing method, a sinking process is carried out after cold rolling, and in the process of cold rolling, an inner grooved steel tube having an outside diameter of greater than a target size is manufactured, and then the outside diameter of the steel tube is reduced by the sinking process, such that the inner grooved tube having the desired size is manufactured.

In the manufacturing method disclosed in U.S. Pat. No. 5,016,460, the rate of reduction in the cold rolling can be decreased, so that the load applied to a mandrel may be reduced. However, only a decrease in the rate of reduction is insufficient to suppress the generation of crackings in the hot worked material having less toughness. On the contrary, an excessive decrease of the rate of reduction causes the number of sinking processes to be increased after cold rolling. Since, moreover, the sinking process providing a relatively inaccurate dimensional precision has to be applied to the inner grooved tube for the finishing, there is a problem that the inner grooved tube has low dimensional precision of the inner surface.

As described above, in the case where a seamless steel tube is manufactured by the cold rolling from a tubing material having less workability, a number of crackings generate, when the tubing material manufactured by the hot working is directly used to reduce the diameter the seamless steel tube after applying only the surface treatment and/or the lubricating treatment thereto. Since, moreover, every tube has a dimensional variation in the hot-rolled tubing material, there is a problem in which the rate of reduction must be decreased in the cold rolling to prevent the breakage of the mandrel.

On the other hand, a tubing material, which is manufactured by the hot extrusion process or the like, has to be finally cold-rolled to obtain an inner grooved tube having a small diameter and thickness. Hence, there is a risk that a mandrel is broken at a high rate of reduction for a material having less workability. To overcome this problem, the above-mentioned U.S. Patent has disclosed the method for applying the sinking process to the steel tube after cold rolling in order to reduce the load applied to the mandrel. Nevertheless, various problems still remain in this method.

SUMMARY OF THE INVENTION

In view of the above-mentioned problems in manufacturing a seamless steel tube having a round shape or a shape other than the round shape, the present invention is accomplished. It is an object of the present invention to provide a method for manufacturing a seamless steel tube, which is capable of preventing the following troubles, that is, crackings in the material resulting from low toughness and a greater deformation resistance of the tubing material, breakage or damage of a mandrel resulting from a variation in the size of the tubing material or a damage of the mandrel in conjunction with the process of manufacturing an inner grooved tube, in cold rolling a tubing material having less workability, which is manufactured by the hot working.

In order to solve the above-mentioned object, the present inventor intensively investigated a method for manufacturing a seamless steel tube from various materials having less workability by combining the hot working process with the cold working process. As a result, the following facts A–C were found:

A. In manufacturing a steel tube by the hot working process from a high Cr—high Ni—high C alloy steel of materials having less workability, relatively low temperature portions in the material exist due to the nonuniformity in the heating of a billet before the hot working process and/or that the steel tube is manufactured at a relatively low temperature to suppress the melt of the grain boundaries due to the process heat at the hot working, so that the carbides precipitate in the grain boundaries to reduce the toughness. In particular, an alloy steel including stabilizing elements, such as Ti, Nb and others, provides an increased amount of carbide precipitates.

In order to recover the toughness of such an alloy steel including precipitated carbides, it is effective to apply the heat treatment for solid solution to the steel tube after cold drawing. The conventional heat treatment for solid solution makes it possible to recover the toughness of the steel. When the cold working process is further carried out before the heat treatment for the solid solution, the recrystallization during the heat treatment as well as the solid solution of carbides is enhanced, and therefore the toughness may be recovered more than the case of applying the heat treatment only.

B. In manufacturing a steel tube by the hot working process from a high purity ferritic stainless steel of materials having less workability, a higher temperature in the hot working process occasionally causes coarse crystal grains to be generated. In addition, a variation in the cooling rate after the hot working process causes chromium nitrides to be generated in the case of, for example, ASTM A268 TP446, and similarly intermetallic compounds including a Laves phase to be generated in the case of JIS SUS444, so that the toughness is greatly reduced.

In order to recover the toughness of a ferritic stainless steel providing chromium nitrides or intermetiallic compound precipitates, the hot treatment process is normally applied thereto before cold working. Since the status of recrystallization is influenced by the amount of residual strain resulting from the hot working process, this heat treatment may grow coarse crystal grains, thereby making it impossible to recover the toughness. When the heat treatment is carried out after cold drawing in an appropriate rate of reduction, additional strain applied is averaged over the entire area of the steel tube and fine grains can be uniformly formed, thereby enabling the toughness to be steadily recovered.

C. When the size of a tubing material is adjusted by the cold drawing process before carrying out the finishing process by the cold rolling, the breakage no longer takes place in the mandrel, and the rate of reduction can be enhanced in the cold rolling process. The cold drawing process hardly provides such abrasion of a tool as encountered in the case of the hot working process. Accordingly, a continuous process for the production is feasible, using the same tool, and a change of each and every tube in the size of a finished steel tube is very small. In addition, the abrasion of the tool can be practically neglected, so that a variation of the size in the axial direction does not take place.

The present invention is provided on the basis of the above-mentioned experimental facts, and the gist of the invention resides in the following methods (1), (2) and (3) for manufacturing a seamless steel tube:

(1) A method for manufacturing a seamless steel tube, wherein a tubing material for the seamless steel tube is produced from a material having less workability by the hot working process, and then the tubing material is applied a heat treatment after cold drawing at a reduction rate of not less than 15 %, and thereafter the steel tube thus heat-treated is cold rolled. Moreover, it is preferable that a tubing material for the seamless steel tube is manufactured by employing the hot extrusion process as a hot working process.

(2) In the above mentioned method (1) for manufacturing a seamless steel tube, the material having less workability is exemplified either an alloy steel including Cr at a content of not less than 15 weight % and Ni at a content of not less than 20 weight % or a ferritic stainless steel including Cr at a content of not less than 16 weight %.

(3) The above-mentioned methods (1) and (2) for manufacturing a seamless steel tube is employed as a method for manufacturing an inner grooved steel tube.

DESCRIPTION OF PREFERRED EMBODIMENTS

In the present invention, both a high Cr—high Ni—high C alloy steel and a high purity ferritic stainless steel are included in materials having less workability, which materials have high deformation resistance and low toughness in the state of the hot worked steel tube, so that crackings generate in the cold rolling process.

JIS NCF 800H steel is included in a high Cr—high Ni—high C alloy steel. The composition of steels similar thereto is exemplified in Table 1.

TABLE 1

| | |
|---|---|
| NCF 800H | 20% Cr—30.5% Ni—0.07% C system<br>24.5% Cr—38.0% Ni—0.15% C system<br>25.5% Cr—24.5% Ni—0.21% C system |

The present invention deals with an alloy steel including Cr at a content not less than 15% and Ni at a content of not less than 20% as an actual material having less workability, taking the examples of composition in Table 1 into account. Regarding the content of C, no special definition is made in the present invention, since detailed empirical information has already been obtained over a wide range of the C content. In accordance with the present inventor's reviewing, the range of high C content in the present invention is preferably not less than 0.04%.

ASTM A268-TP446, TPXM-8 or JIS SUS444 steel is included in a high purity ferritic stainless steel. The composition of these steels is listed in Table 2.

TABLE 2

| | |
|---|---|
| SUS 444 | 19% Cr—2% Mo—low C (<0.01%) |
| SUSXM 8 | 18% Cr—0.5% Mn—0.4% Ti—low C (<0.01%) |
| TP 446 | 24% Cr—1% Mn—0.1% C |
| SUSXM 27 | 26% Cr—1% Mo—low C (<0.01%) |

The present invention deals with a ferritic stainless steel including Cr at a content of not less than 16% as a material having less workability, taking the examples of composition in Table 2 into account. In particular, the present invention deals with either a ferritic stainless steel including Cr at a content of not less than 16% and C at a content of not more than 0.01% or a ferritic stainless steel including Cr at a content of not less than 20%.

In the manufacturing method according to the present invention, no special limitation is assigned for manufacturing a tubing material in the hot working process. The hot piercing process is highly efficient as a method for manufacturing a tubing material in the hot working process. However, it is preferable that a certain limitation should be assigned for the conditions of manufacturing the steel tube, checking the observed results, either of generating the plug fusion or defects on the inside surface of the tubing material resulting from a high deformation resistance, as described above, in the case of piercing the high Cr—high Ni—high C alloy steel, or of generating the lap-type defects in the reducing process in the case of piercing the ferritic stainless steel. The hot extrusion process provides a relatively small amount of defects, compared with the hot piercing method, and therefore it is excellent in producing the steel tube from such a material having less workability.

In the method for manufacturing a steel tube according to the present invention, a combination of a cold drawing and a heat treatment after it are carried out in order to adjust the size of a tubing material before the finishing process by a cold rolling and to recover the toughness of the tubing material. In the drawing process, it is assumed that a reduction rate of 8% is sufficient, so long as the drawing process is carried out for only the size adjustment of the tubing material. However, at a reduction rate of less than 15%, it is difficult to uniformly draw the tubing material over the entire range of the tube thickness, and therefore inhomogeneous grain growth takes place during the recrystallization after the heat treatment, thereby causing the toughness of the tubing material to be insufficiently recovered.

In view of this fact, it is preferable that the rate of reduction in the cold drawing process should be not less than 15%. The upper limit of the reduction rate is not defined. When, however, a normal round tube is cold-drawn at a reduction rate of more than 40%, the drawn tube is occasionally fractured. Accordingly, the upper limit of the reduction rate is limited by the yield strength in the drawing process of the tubing material.

The heat treatment after the cold drawing process serves to remove the strain resulting from the cold drawing process along with softening and also to generate fine grains in the recrystallization, thereby enabling the toughness of the tubing material to be effectively recovered by solving the precipitates therein. In actual conditions of heat treatments, the tubing material is heated for 1–10 min. at 1100–1250° C., and then quenched in the case of the high Cr—high Ni—high C alloy steel, whereas the tubing material is heated for 1–10 min. at 700–950° C. and then quenched in the case of the ferritic stainless steel.

Moreover, when a tubing material hot extruded is cold drawn, such abrasion of tools as in the hot work process hardly occurs in the cold work process, so that the same tool may be continuously used in the tube-making process, thereby enabling the variation in the size of every tube to be reduced. Because no substantial abrasion of the tool occurs, such a variation of the size encountered in the hot extrusion process is very small in the axial direction.

In accordance with the manufacturing method according to the present invention, the final finishing is carried out by the cold rolling either for a round tube or for an inner grooved tube. A cold Pilger mill used for the cold rolling is comprising a pair of upper and lower roll dices having holes formed on the circumferential surface, and a mandrel tapered to the ends is interposed between the roll dices.

These roll dices are supported by a roll stand with a rotary shaft disposed on the center of their axes.

In the cold rolling process, the roll dices supported by the roll stand move in the reciprocating manner along the mandrel, and thus allow the tubing material to be rolled with the reciprocating rotation of the roll dices. During the steps of the reciprocating rotation of the roll stand, the tubing material is fed by a predetermined length and simultaneously rotated by a predetermined angle, and thereby both the diameter and the wall thickness of the tubing material are stepwise reduced. Hence, the cold rolling process with the cold Pilger mill having such a structural arrangement is capable of providing a higher rate of reduction, compared with the cold drawing process.

EXAMPLES

The advantages and other features of the method for manufacturing a seamless steel tube according to the present invention will be described, as for both an inner grooved tube and a round tube.

Example 1

In Example 1, a tubing material having a round shape was manufactured by the hot extrusion process, and subsequently an inner grooved tube was formed using the tubing material by the cold rolling process. The chemical composition for two types A and B of the steel materials used is summarized in Table 3. Using these steel materials, tubing materials in a varied size were manufactured by the hot extrusion process, and the tubing materials thus manufactured were heated at 1220° C. for 3 min. directly, or after cold drawing at a reduction rate of 12% –18%, and thereafter the tubing materials were water-cooled and then cold rolled. Under the producing conditions commonly used in the cold rolling process, an inner grooved tube was manufactured from each of these tubing materials, wherein it had a 50.8 mm outside diameter, a thickness of 11.9 mm at the highest level of the inner surface, a thickness of 6.9 mm at the lowest level of the inner surface and 8 grooves or fins disposed on the inner surface.

TABLE 3

| Steel | Chemical Composition (weight %, Residual: Fe) | | | | | | | | | | |
|---|---|---|---|---|---|---|---|---|---|---|---|
| type | C | Si | Mn | Cu | Ni | Cr | Mo | Co | V | Ti | Nb |
| A | 0.20 | 0.33 | 0.40 | 0.14 | 24.44 | 25.13 | 0.15 | 0.27 | 0.07 | 0.45 | 0.01 |
| B | 0.11 | 1.56 | 0.42 | 0.33 | 38.93 | 24.38 | 1.30 | 0.38 | 0.11 | 0.40 | 0.05 |

The processing conditions in the drawing process, the processing conditions in the cold rolling process, the rate of generating crackings and the service life of the mandrel in Example 1 are all listed in Table 4. The rate of generating crackings was determined by the inspection of the inner grooved tube with visual examination. Each mark indicates a cracking generating rate: ○ means less than 5%; Δ means 5–10%; and x means not less than 10%. The service life of the mandrel is indicated as the total length of the tube cold rolled till the mandrel is broken.

TABLE 4

| Tube No. | Tubing material to be Rolled | Material | Reduction Rate in Drawing | Reduction Rate in Rolling | Rate of Generating Crackings | Service Life of Mandrel |
|---|---|---|---|---|---|---|
| Comparative Example | | | | | | |
| 1 | as hot extruded | A | — | 52% | Δ | 850 m |
| 2 | as hot extruded | A | — | 59% | x | 210 m |
| 3 | as hot extruded | B | — | 52% | x | 850 m |
| 4 | as hot extruded | B | — | 59% | x | 210 m |
| 5 | hot extrusion + cold drawing + heat treatment | B | 12% | 52% | Δ | 2500 m |
| 6 | hot extrusion + cold drawing + heat treatment | B | 12% | 59% | x | 1800 m |
| Inventive Example | | | | | | |
| 7 | hot extrusion + cold drawing + heat treatment | A | 18% | 52% | ○ | 2500 m |
| 8 | hot extrusion + cold drawing + heat treatment | A | 18% | 52% | ○ | 1800 m |

TABLE 4-continued

| Tube No. | Tubing material to be Rolled | Material | Reduction Rate in Drawing | Reduction Rate in Rolling | Rate of Generating Crackings | Service Life of Mandrel |
|---|---|---|---|---|---|---|
| 9 | hot extrusion + cold drawing + heat treatment | B | 18% | 52% | ○ | 2500 m |
| 10 | hot extrusion + cold drawing + heat treatment | B | 18% | 59% | ○ | 1800 m |
| 11 | hot extrusion + cold drawing + heat treatment | B | 18% | 59% | ○ | 1500 m |

From the results in Table 4, an increased rate of generating crackings is discerned in the steel tubes No. 1–No. 4, which are cold rolled as hot extruded, No. 5 and No. 6, which are cold rolled in the heat treatment for the solid solution after they are hot extruded and then cold drawn in a relatively small reduction rate of 12%.

On the contrary, a decreased rate of generating crackings is found in the steel tubes No. 7–No. 11 of the inventive example.

The service life of the mandrel was not more than 850 m and it is unsatisfactory as for the steel tubes, No. 1–No. 4, each of which was cold rolled as hot extruded, whereas the service life was not less than 1500 m and it was a satisfactory result as for the steel tubes, No. 7–No. 11, each of which was obtained by cold rolling a tubing material to which a heat treatment of heating at 1220° C. for 3 min. and the water cooling was applied after cold drawing at a reduction rate of 18%.

Example 2

In Example 2, three different types C–E of steels shown in Table 5 were used to manufacture tubing materials by the hot extrusion process. After each manufactured tubing materials was treated under various conditions: in the state in which the tubing material was hot extruded; in the state in which the tubing material either was or not cold-drawn after hot extruding; and in the state in which a heat treatment either is or not applied to the primary either after the hot extruding and subsequently cold drawing. Thereafter, the tubing materials were cold rolled to manufacture a steel tube having a 50.8 mm outside diameter and a 3 mm thickness. The above-mentioned heat treatment condition is as follows: The tubing material was heated at 1220° C. for 3 min. and then water-cooled as for steel type C; the tubing material was heated at 900° C. for 10 min. and then water-cooled as for steel type D; and the tubing material was heated at 850° C. for 10 min. and then water-cooled as for steel type E.

The relationship among the processing conditions and the toughness of the tubing material before the cold rolling and the rate of generating crackings in the cold rolling is shown in Table 6. The toughness of the tubing material was determined by the Charpy impact test value. The Charpy test temperature was 20° C. as for steel type C; 60° C. as for steel type D; and 80° C. as for steel type E. The rate of generating crackings was determined by the ultrasonic inspection test. In Table 6, ○ means a cracking generating rate of less than 5%; Δ means a cracking generating rate of 5–10%; and x means a cracking generating rate of not less than 10%.

From the result in Table 6, it is found that, in the steel tubes cold rolled as hot extruded, No. 1, No. 4 and No. 7; the steel tubes heat-treated and cold rolled after the hot extrusion, No. 2, No. 5 and No. 8; and the steel tubes heat-treated and cold rolled after drawing at the reduction rate of 12%, No. 6 and No. 9, the Charpy absorbed energy is not more than 70 J and the rate of generating cracking due to the reduction of the toughness increases.

On the other hand, the Charpy absorbed energy is not less than 70 J in the steel tubes No. 10–No. 15 of the inventive example, thereby enabling the generation of cracking to be suppressed after the cold rolling.

As described above, in accordance with the method for manufacturing a seamless steel tube by the present invention, a tubing material was heat-treated after the cold drawing, and therefore the toughness thereof was efficiently recovered in the cold rolling process using the tubing material having less workability which was manufactured by the hot working. As a result, the material crackings resulting from low toughness and a high deformation resistance of a tubing material, and the breakage of a mandrel resulting from a variation in the size of the tubing material or the breakage of the mandrel in the production of the inner grooved tube could be suppressed.

TABLE 5

| Steel | Chemical Composition (weight %, Residual: Fe) | | | | | | | | | | |
|---|---|---|---|---|---|---|---|---|---|---|---|
| type | C | Si | Mn | Cu | Ni | Cr | Mo | Co | V | Ti | Nb |
| C | 0.20 | 0.33 | 0.40 | 0.14 | 24.44 | 25.13 | 0.15 | 0.27 | 0.07 | 0.45 | 0.01 |
| D | 0.074 | 0.51 | 1.01 | 0.02 | 0.27 | 23.63 | 0.06 | — | — | 0.01 | 0.01 |
| E | 0.0055 | 0.49 | 0.50 | 0.02 | 0.15 | 18.07 | 0.08 | — | — | 0.35 | 0.35 |

TABLE 6

| Tube No. | Treatment for Tubing material | Material | Reduction Rate in Drawing | Charpy Absorhed Energy (J) | Reduction Rate in Rolling | Rate of Generating Crackings |
|---|---|---|---|---|---|---|
| Comparative Example | | | | | | |
| 1 | as hot extruded | C | — | 50 | 65% | x |
| 2 | hot extrusion + heat treatment | C | — | 60 | 65% | Δ |
| 3 | hot extrusion + cold drawing + heat treatment | C | 12% | 60 | 65% | Δ |
| 4 | as hot extruded | D | — | 20 | 70% | Δ |
| 5 | hot extrusion + heat treatment | D | — | 20 | 70% | Δ |
| 6 | hot extrusion + cold drawing + heat treatment | D | 12% | 40 | 70% | Δ |
| 7 | as hot extruded | E | — | 55 | 65% | x |
| 8 | hot extrusion + heat treatment | E | — | 75 | 65% | Δ |
| 9 | hot extrusion + cold drawing + heat treatment | E | 12% | 70 | 65% | Δ |
| Inventive Example | | | | | | |
| 10 | hot extrusion + cold drawing + heat treatment | C | 19% | 75 | 65% | ○ |
| 11 | hot extrusion + cold drawing + heat treatment | C | 19% | 75 | 75% | ○ |
| 12 | hot extrusion + cold drawing + heat treatment | D | 19% | 70 | 70% | ○ |
| 13 | hot extrusion + cold drawing + heat treatment | D | 19% | 70 | 80% | ○ |
| 14 | hot extrusion + cold drawing + heat treatment | E | 21% | 140 | 65% | ○ |
| 15 | hot extrusion + cold drawing + heat treatment | E | 21% | 140 | 80% | ○ |

What is claimed is:

1. A method for manufacturing a seamless steel tube having inner grooves, comprising the steps of:

manufacturing a tubing material for a seamless steel tube from a material having less workability by a hot working process;

cold drawing said tubing material at reduction rate of not less than 15%;

applying a heat treatment to said cold drawn steel tube; and cold rolling the heat-treated steel tube at a reduction rate of not less than 52% by utilizing a cold Pilger mill to form the inner grooved tube, wherein said material having less workability is an alloy steel including Cr at a content of not less than 15 weight % and Ni at a content of not less than 20 weight %.

2. The manufacturing method of claim 1, wherein said tubing material for a seamless tube is manufactured by a hot extrusion process in said hot working process.

3. The manufacturing method of claim 1, wherein in the heat treatment of said material having less workability after cold drawing, the heat treatment comprises heating at 1100–1250° C. for 1–10 minutes and rapid cooling.

* * * * *